US006523294B2

(12) United States Patent
Curry et al.

(10) Patent No.: US 6,523,294 B2
(45) Date of Patent: Feb. 25, 2003

(54) REVOLVER-SAFETY LOCK MECHANISM

(75) Inventors: Brett Curry, Chicopee, MA (US); Owen Patrick Cramer, Springfield, MA (US); Richard F. Mikuta, Easthampton, MA (US); James M. Quill, Ludlow, MA (US); Kevin R. Fleury, Agawam, MA (US)

(73) Assignee: Smith & Wesson Corp., Springfield, MA (US)

( * ) Notice: Subject to any disclaimer, the term of this patent is extended or adjusted under 35 U.S.C. 154(b) by 0 days.

(21) Appl. No.: 09/834,004

(22) Filed: Apr. 12, 2001

(65) Prior Publication Data

US 2002/0148152 A1 Oct. 17, 2002

(51) Int. Cl.[7] ..... F41A 17/74; F41A 17/30; F41A 17/00

(52) U.S. Cl. ..... 42/66; 42/67; 42/70.08

(58) Field of Search ..... 42/65, 66, 70.11, 42/70.08, 67

(56) References Cited

U.S. PATENT DOCUMENTS

| | | | | | |
|---|---|---|---|---|---|
| 635,705 | A | * | 10/1899 | Wesson et al. | 42/66 |
| 2,579,736 | A | * | 12/1951 | Gartner | 42/66 |
| 3,462,869 | A | * | 8/1969 | Wallace | 42/70.08 |
| 3,882,622 | A | * | 5/1975 | Perlotto | 42/70.11 |
| 3,942,691 | A | | 3/1976 | Sisak | |
| 3,978,603 | A | * | 9/1976 | Murabito | 42/66 |
| 4,030,221 | A | | 6/1977 | Doobenen et al. | |
| 4,065,998 | A | | 1/1978 | Rocha | |
| 4,084,341 | A | | 4/1978 | Cervantes | |
| 4,091,557 | A | * | 5/1978 | Murabito | 42/66 |
| 4,299,045 | A | | 11/1981 | Cervantes | |
| 4,398,366 | A | | 8/1983 | Wernicki | |
| 4,627,185 | A | | 12/1986 | Rohm | |
| 4,769,936 | A | | 9/1988 | Miller | |
| 4,894,939 | A | * | 1/1990 | Perry | 42/66 |
| 4,909,129 | A | | 3/1990 | Reynolds | |
| 4,972,618 | A | * | 11/1990 | Justice, Sr. et al. | 42/70.11 |
| 4,995,180 | A | | 2/1991 | Tucker et al. | |
| 5,012,606 | A | | 5/1991 | McNulty, Jr. | |
| 5,042,185 | A | * | 8/1991 | Justice, Sr. | 42/70.11 |
| 5,125,178 | A | * | 6/1992 | Justice | 42/70.11 |
| 5,153,360 | A | | 10/1992 | Upton | |
| 5,225,612 | A | | 7/1993 | Bernkrant | |
| 5,239,767 | A | | 8/1993 | Briley, Jr. et al. | |
| 5,271,174 | A | | 12/1993 | Bentley | |
| 5,325,686 | A | | 7/1994 | Bentley | |
| 5,412,959 | A | | 5/1995 | Bentley | |
| 5,457,907 | A | | 10/1995 | Brooks | |
| 5,475,994 | A | | 12/1995 | Briley, Jr. et al. | |
| 5,488,794 | A | | 2/1996 | Arrequin | |
| 5,535,605 | A | | 7/1996 | Werner | |
| 5,544,440 | A | | 8/1996 | Stockman | |
| 5,551,181 | A | | 9/1996 | Upton | |
| 5,560,132 | A | | 10/1996 | Merlino | |

(List continued on next page.)

*Primary Examiner*—Charles T. Jordan
*Assistant Examiner*—John W. Zerr
(74) *Attorney, Agent, or Firm*—McCormick, Paulding & Huber LLP

(57) ABSTRACT

A revolver is provided that includes a frame, a barrel, a cylinder, a hammer, a trigger, and a safety lock mechanism. The safety lock mechanism includes a lockarm and a lockarm actuator. The hammer includes a normal slot and a lock slot. The lockarm includes a cam surface and hammer post, and is pivotally mounted relative to the frame. The lockarm actuator is disposed in the frame. The lockarm actuator includes a head and a cam, and the cam is aligned with the cam surface of the lockarm so as to be engageable with the cam surface. The lockarm actuator can be positioned in a safety-off condition in which the hammer post of the lockarm is received within the normal slot of the hammer and the hammer is operable. The lockarm actuator can also be positioned in a safety-on condition in which the hammer post is received within the lock slot and the hammer is inoperable.

22 Claims, 5 Drawing Sheets

U.S. PATENT DOCUMENTS

| | | | | |
|---|---|---|---|---|
| 5,579,909 | A | 12/1996 | Deal | |
| D381,254 | S | 7/1997 | Collins | |
| 5,671,560 | A | 9/1997 | Meller | |
| 5,673,506 | A | * 10/1997 | Pantuso et al. | 42/67 |
| 5,704,152 | A | 1/1998 | Harrison et al. | |
| 5,732,497 | A | 3/1998 | Brooks | |
| 5,749,166 | A | 5/1998 | Brooks | |
| 5,860,241 | A | 1/1999 | Waters | |
| 5,910,003 | A | 6/1999 | Kleinpaul | |
| 5,913,666 | A | 6/1999 | Perkins | |
| 5,918,492 | A | 7/1999 | Klebes | |
| 5,950,344 | A | 9/1999 | Ross | |
| 6,009,654 | A | 1/2000 | Williams et al. | |

* cited by examiner

REVOLVER-SAFETY LOCK MECHANISM

BACKGROUND OF THE INVENTION

1. Technical Field

This invention relates to safety devices for firearms in general, and to safety devices for revolvers in particular.

2. Background Information

A revolver includes a frame, a cylinder, a firing mechanism, and a barrel. The cylinder includes an ejector, a ratchet, a plurality of chambers, and a cylinder retaining mechanism. The cylinder is mounted on the frame by a yoke pivotally attached to the frame. In the cylinder-closed position, the cylinder retaining mechanism retains the cylinder within the frame. A cylinder release bar that can be moved via a thumb piece is provided to actuate the retaining mechanism and thereby allow the cylinder and yoke to be rotated away from the frame into the cylinder-open position. The firing mechanism includes a trigger, a sear, a hammer, a main spring, and a pawl that is sometimes referred to as a "hand". When the revolver is in an operable mode, pulling the trigger causes the pawl to engage the ratchet and thereby rotate the ratchet and attached cylinder. Pulling the trigger also causes the sear and the hammer to rotate away from the cylinder. The rotation away from the cylinder is resisted by the main spring. After a predetermined amount of travel, the sear and hammer disengage from the trigger and allow the spring to force the hammer toward the cylinder. The hammer is aligned with one of the cylinder chambers and the cylinder chamber, in turn, is aligned with the barrel. A hammer nose attached to the hammer is positioned to strike the cartridge disposed in the chamber.

DISCLOSURE OF THE INVENTION

According to the present invention, a revolver is provided that includes a frame, a barrel, a cylinder, a hammer, a trigger, and a safety lock mechanism.

One embodiment of the safety lock mechanism includes a lockarm and a lockarm actuator. The hammer includes a normal slot and a lock slot. The lockarm includes a cam surface and hammer post, and is pivotally mounted relative to the frame. The lockarm actuator is disposed in the frame. The lockarm actuator includes a head and a cam, and the cam is aligned with the cam surface of the lockarm so as to be engageable with the cam surface. The lockarm actuator can be positioned in a lockarm-disengaged position in which the hammer post of the lockarm is received within the normal slot of the hammer and the hammer is operable. The lockarm actuator can also be positioned in a lockarm-engaged position in which the hammer post is received within the lock slot and the hammer is inoperable.

Another embodiment of the safety lock mechanism includes a lockpin movable into the frame. The lockpin can be positioned in a lockpin-disengaged position in which the lockpin is disengaged from the hammer and the cylinder release bar. The lockpin can also be positioned in a lockpin-engaged position in which the lockpin is engaged with the hammer and the cylinder release bar. In the lockpin-engaged position, the hammer is maintained in an uncocked position, and the cylinder release bar is maintained in a cylinder-release position, thereby permitting rotation of the cylinder out of the frame.

An advantage of the present invention is that the cylinder can be rotated out of the frame for inspection while either embodiment of the safety lock is engaged. An advantage of the present invention safety lock embodiment that utilizes a lockarm and a lockarm actuator is that the cam and cam surface are designed to hold the safety lock in either the engaged or disengaged mode.

These and other objects, features, and advantages of the present invention will become apparent in light of the detailed description of the present invention.

DETAILED DESCRIPTION OF THE INVENTION

Figure 1:
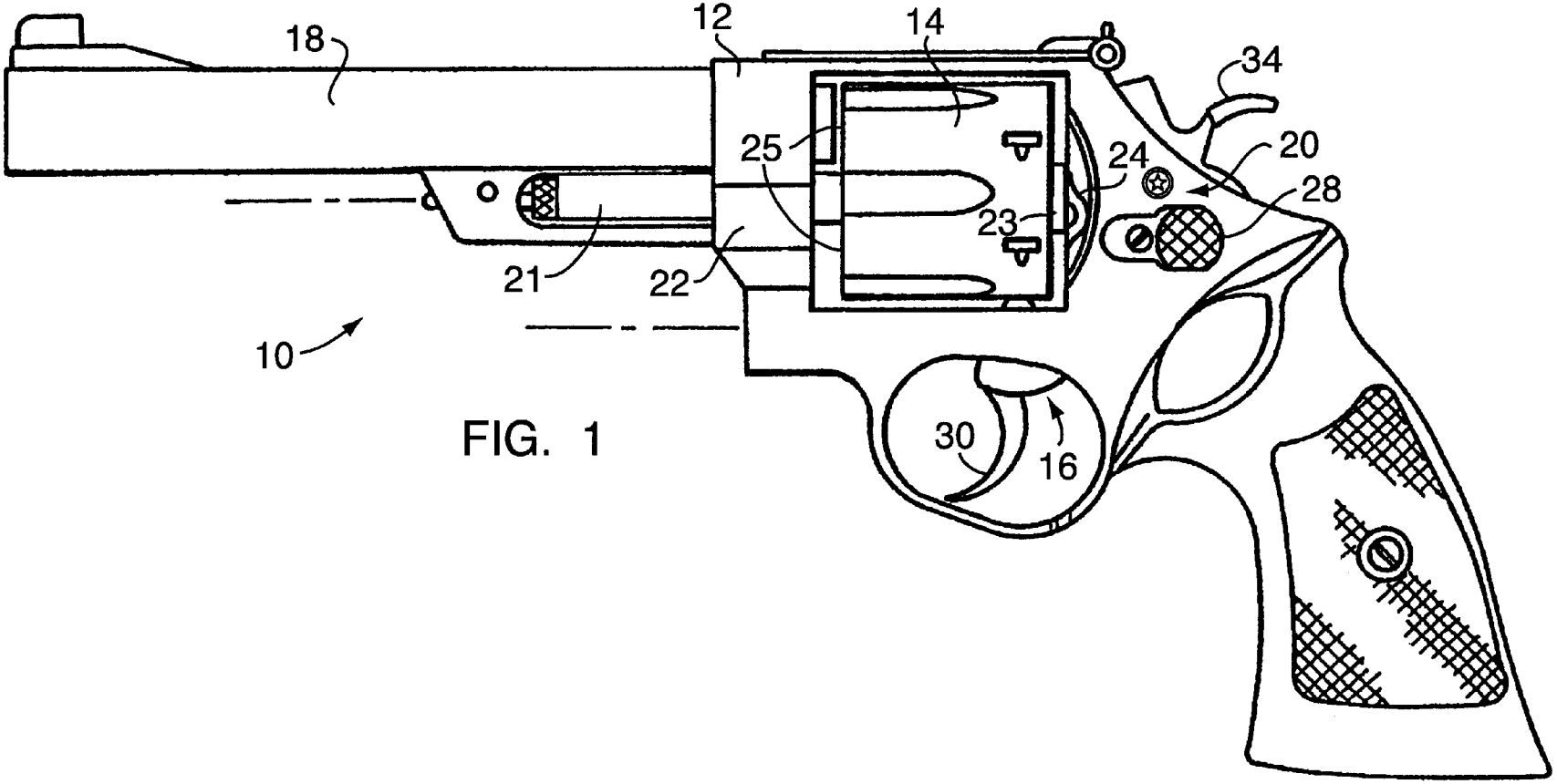
FIG. 1 is a side view of a revolver.

Now referring to FIG. 1, a revolver 10 includes a frame 12, a cylinder 14, a firing mechanism 16, a barrel 18, and a safety lock mechanism 20. The cylinder 14 includes an ejector 21, a ratchet 23, and a plurality of chambers 25. The cylinder 14 is mounted on the frame 12 by a yoke 22 pivotally attached to the frame 12. In the cylinder-closed position, a retaining mechanism 24 retains the cylinder 14 within the frame 12. A cylinder release bar 26 (see FIGS. 2 and 8) that can be moved via a thumb piece 28 is provided to actuate the retaining mechanism 24 and thereby allow the cylinder 14 and yoke 22 to be rotated away from the frame 12 into the cylinder-open position. The firing mechanism 16 includes a trigger 30 and a hammer 34.

Figure 2:
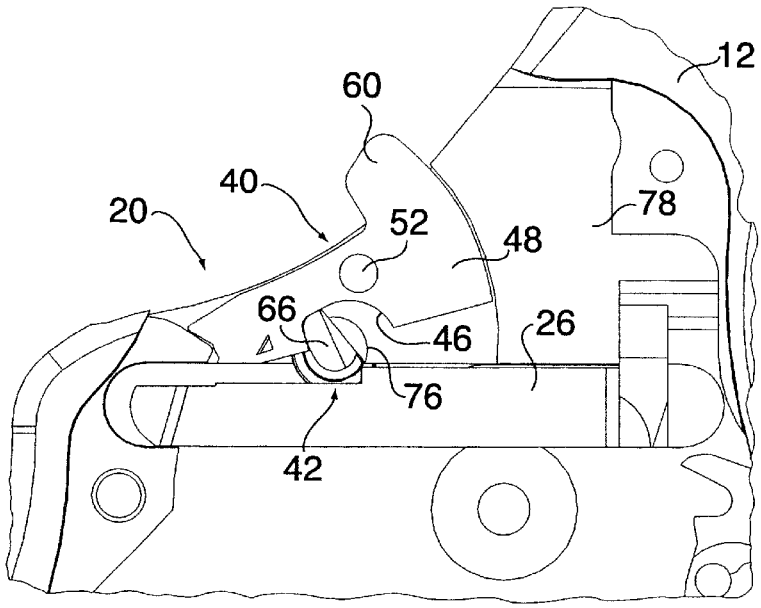
FIG. 2 is a sectioned partial diagrammatic view of a revolver showing an embodiment of the present invention safety lock mechanism that includes a lockarm and a lockarm actuator.
Figure 3:
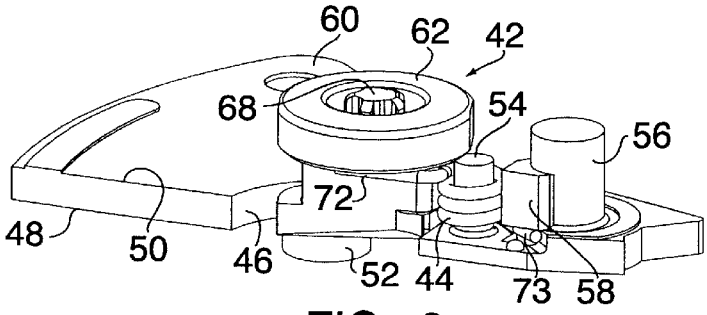
FIG. 3 is a diagrammatic isometric view of the lockarm, lockarm actuator, and lockarm spring assembled relative to one another.
Figure 4:
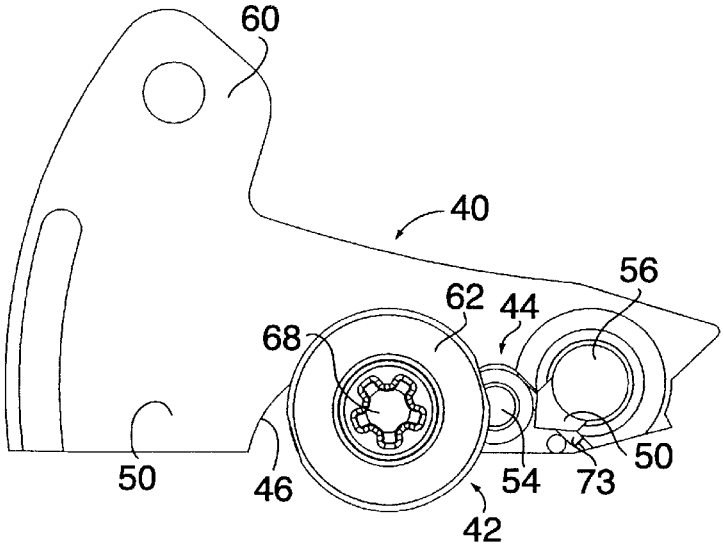
FIG. 4 is planar view of the assembly shown in FIG. 3.
Figure 5:
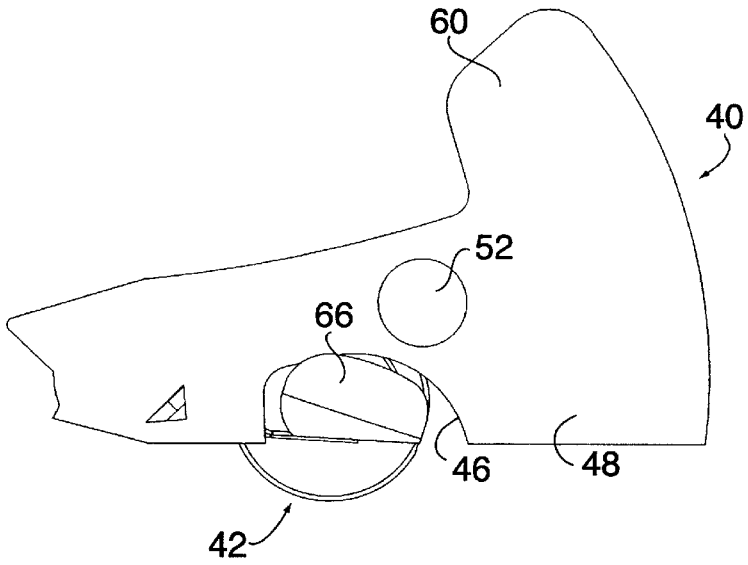
FIG. 5 is a planar view of the assembly shown in FIG. 3 from the side opposite that shown in FIG. 4.
Figure 6:
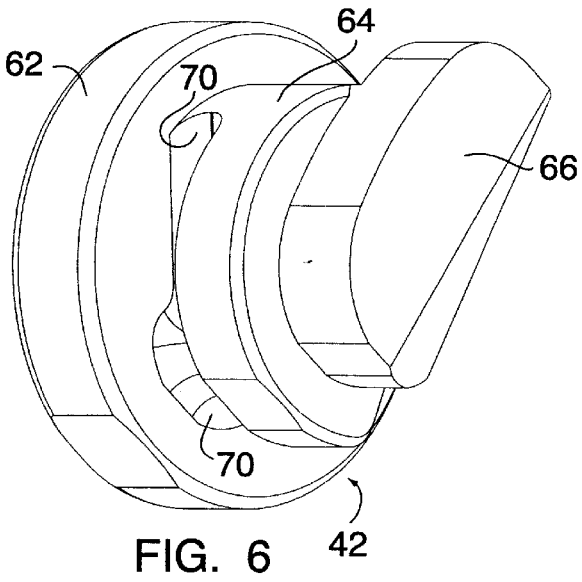
FIG. 6 is a diagrammatic isometric view of the lockarm actuator.

Referring to FIGS. 2–7, a first embodiment of the safety lock mechanism 20 includes a lockarm 40, a lockarm actuator 42, and a lockarm spring 44 (see FIGS. 3–5). The lockarm 40 has a cam surface 46 extending between a first side surface 48 and a second side surface 50. A hammer post 52 for engagement with the hammer 34 (see FIGS. 1 and 7) extends out from the first side surface 48. A spring mounting post 54 and a pivot post 56 with a spring retainer 58 extend out from the second side surface 50. The lockarm 40 further includes a flag 60. The lockarm actuator 42 (see FIG. 6) includes a head 62, a support shoulder 64, and a cam lobe 66. The head 62 includes a face geometry 68 that enables the actuator 42 to be connected with and driven by an independent driver tool (not shown) such as a screw driver, an allen wrench, a torx driver, a square key, a custom driver, etc. The support shoulder 64 includes one or more reliefs 70 for receiving one leg 72 (see FIG. 3) of the lockarm spring 44. Referring to FIGS. 2 and 3, the cam lobe 66 is sized to provide the amount of travel necessary to: 1) raise the flag 60 out of the frame 12 to a position where it can be seen by the operator when the safety lock mechanism is in the safety-on condition; and 2) move the hammer post 52 into engagement with a lock slot 74 (see FIG. 7) within the hammer 34 as will be described below. The lockarm spring 44 is a torsion wire type spring having a pair of legs 72,73. One leg 73 acts on the lockarm 40 and the other arm 72 acts on the support shoulder 64 of the lockarm actuator 42 as described above.

The lockarm actuator 42 is mounted within a bore 76 disposed in the sidewall 78 of the frame 12 adjacent the thumb piece 28. The bore 76 includes a countersink portion for receiving the actuator head 62 allowing it to be at or below the surface level of the frame sidewall 78. The cam lobe 66 extends out from the inner surface of the sidewall 78. The lockarm 40 is pivotally mounted on the inner surface of the sidewall 78 by the pivot post 56 which is received within an aperture disposed within the sidewall 78. The cam lobe 66 and the lockarm 40 are relatively positioned so that the cam lobe 66 can engage the cam surface 46 of the lockarm 40. The lockarm spring leg 72 that is received within the relief 70 disposed in the support shoulder 64 retains the lockarm actuator 42 within the frame bore 76. The lockarm spring 44 acts on the lock arm 40, biasing it in the down flag, safety-off condition. The hammer 34 includes an arcuate slot 80 disposed in the side surface 82 of the hammer 34 positioned adjacent the lockarm 40. The lock slot 74 disclosed above extends off of the arcuate slot 80 and is positioned so that the lock slot 74 aligns with the hammer post 52 when the hammer 34 is in the uncocked position. In the safety-off condition, the hammer post 52 is disposed in the arcuate slot 80 of the hammer 34 and the flag 60 resides within the revolver frame 12 adjacent the hammer 34, out of sight. FIG. 5 shows the lockarm actuator 42 in the safety-off condition. When the hammer 34 is drawn back in this condition, the hammer 34 pivots relative to the lockarm 42, rotating past the hammer post 52 that is disposed within the arcuate slot 80. In this condition, the revolver can be fired without obstruction from the lockarm 40.

To actuate the safety lock mechanism 20 into the safety-on condition (as shown in FIG. 2), the operator rotates the lockarm actuator 42 clockwise using a driver tool (e.g., a screwdriver, a torx driver, etc.). When the lockarm actuator 42 is rotated clockwise, the cam lobe 66 engages the cam surface 46 of the lockarm 40 causing the lockarm to pivot about the pivot post 56. The cam 66 rotates the lockarm 40 an amount sufficient to move the hammer post 52 out of the arcuate slot 80 and into the aligned lock slot 74. At the same time, the rotation of the lockarm 40 causes the flag 60 to rise out of the revolver frame 12 into a visible position. In the safety-on condition, the cam 66 and cam surface 46 cooperate with each other in such a way that the lockarm 40 is prevented from being moved into the frame 12; i.e., pushing downward on the flag 60 binds the cam lobe 66 into contact with the cam surface 46. In the safety-on and off positions, this embodiment of the present invention safety lock mechanism 20 does not interact with or obstruct the cylinder release bar 26. As a result, the cylinder 14 can be opened and closed, thereby allowing the operator to inspect the cylinder 14 for ammunition cartridges.

Figure 7:
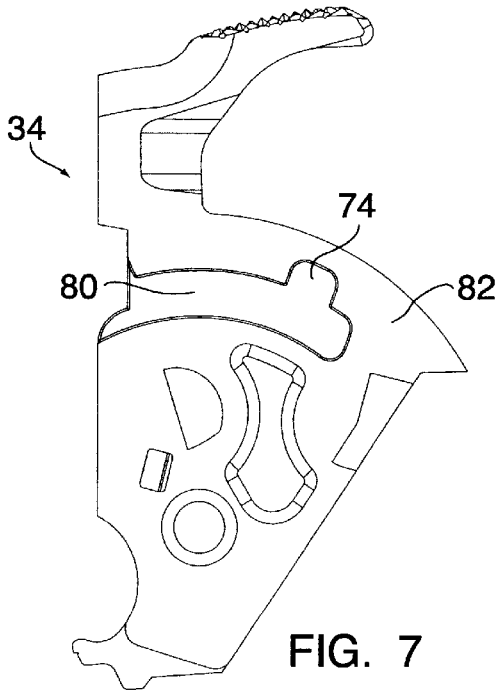
FIG. 7 is a diagrammatic planar view of the hammer.
Figure 8:
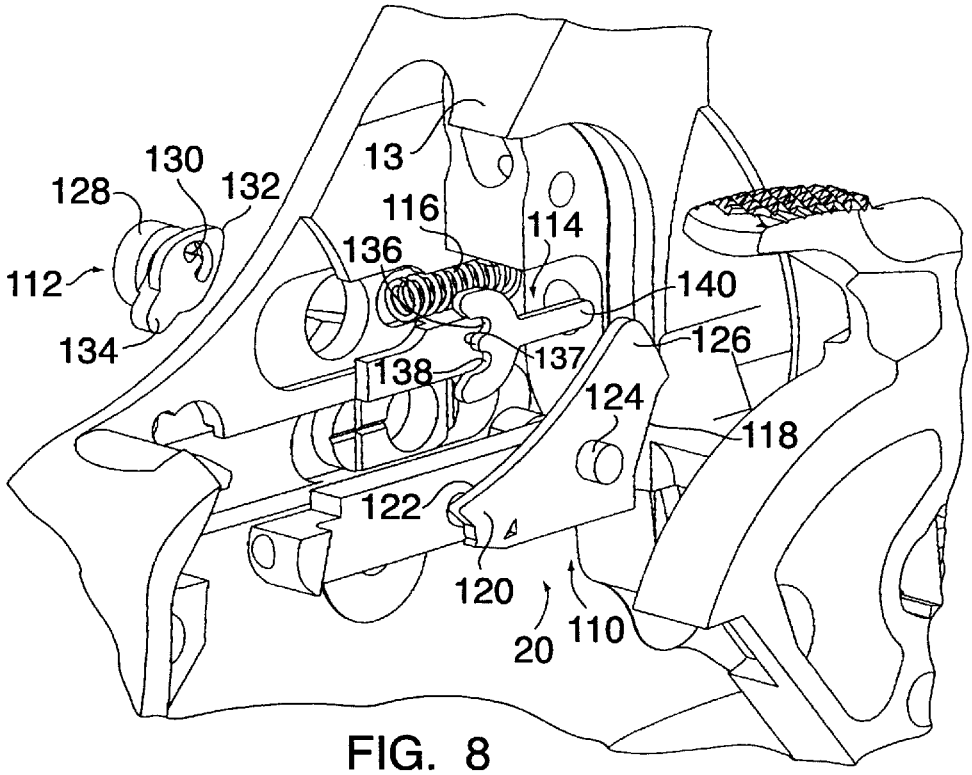
FIG. 8 is a diagrammatic exploded view of a second embodiment of the present safety lock mechanism.
Figure 9:
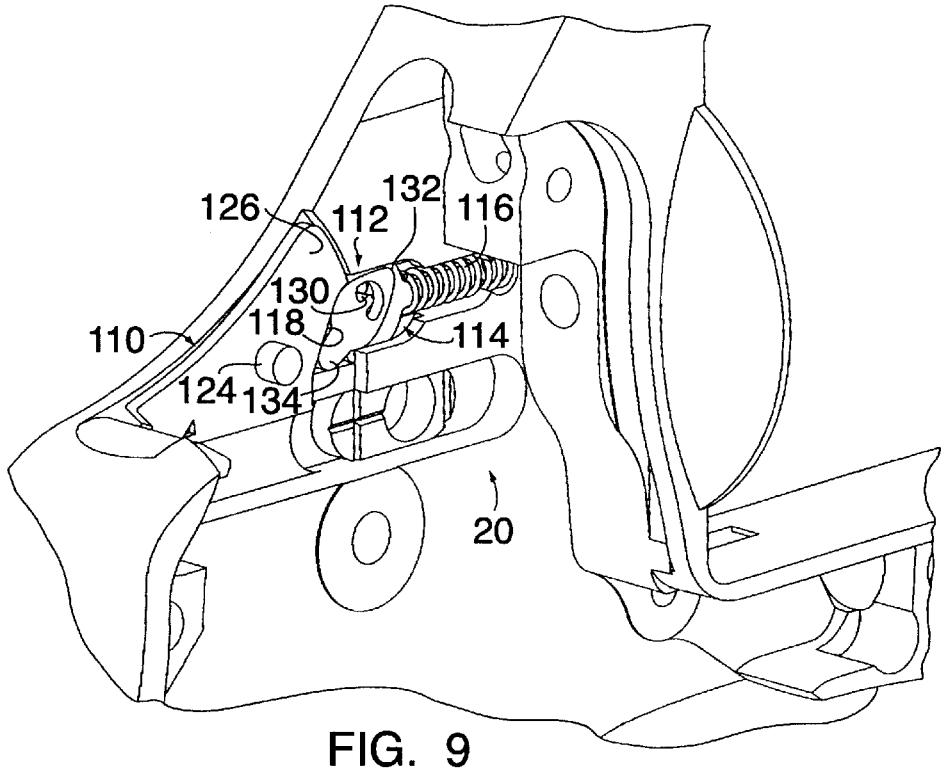
FIG. 9 is a diagrammatic partially assembled view of the second embodiment safety lock mechanism shown in FIG. 8.

FIGS. 8 and 9 show a second version of the safety lock mechanism 20 shown in FIGS. 2–7. FIG. 8 is an exploded view that shows the separate components of the safety lock mechanism 20. FIG. 9 shows the safety lock mechanism 20 partially assembled to show relative positioning of the components. The safety lock mechanism 20 includes a lockarm 110, a lockarm actuator 112, a lockarm actuator catch 114, and a lockarm actuator catch spring 116. The lockarm 110 has a cam surface 118 extending between a first side surface 120 and a second side surface 122. A hammer post 124 for engagement with the hammer 34 extends out from the first side surface 120 and a pivot post (similar to that of the first embodiment) extends out from the second side surface 122. The lockarm 110 further includes a flag 126. The lockarm actuator 112 includes a head 128, a catch tab 130, a retaining flange 132, and a cam lobe 134. The head 128 includes a face geometry that enables the actuator 112 to be connected with and driven by an independent driver tool (not shown) such as a screw driver, an allen wrench, a torx driver, a square key, a custom driver, etc. The catch tab 130 extends between the retaining flange 132 and the head 128. The cam lobe 134 is sized to provide the amount of travel necessary to: 1) raise the flag 126 out of the frame to a position where it can be seen by the operator when the safety lock mechanism 20 is in the safety-on condition; and 2) move the hammer post 124 into engagement with a lock slot 74 within the hammer 34 similar to that described above in the first embodiment. The lockarm actuator catch 114 includes a safety-on notch 136, a safety-off notch 138, a detent tab 137, and a spring post 140. The lockarm actuator catch spring 116 is a coil spring having an internal diameter large enough to receive the spring post 140.

The lockarm actuator 112 is mounted in a manner similar to that of the first embodiment. The lockarm 110 is also pivotally mounted in manner similar to that described in the first embodiment. The cam lobe 134 and the lockarm 110 are relatively positioned so that the cam lobe 134 can engage the cam surface 118 of the lockarm 110. The lockarm actuator catch 114 is disposed between the retaining flange 132 and the head 128. The lockarm actuator catch spring 116 biases the catch 114 into engagement with the lockarm actuator 112, such that the catch tab 130 is received into one of the safety-on notch 136 or safety-off notch 138 of the catch depending on the relative position of the actuator 112. In this position, the catch spring 116 maintains the actuator catch 114 between the flange 132 and the head 128 of the actuator 112, thereby acting as a retainer for the actuator 112. The detent tab 137 disposed between the safety-on notch 136 and the safety-off notch 138 causes the actuator 112 to "click" between settings thereby providing an indicia of change in setting.

As in the first embodiment, the hammer 34 includes an arcuate slot 80 and a lock slot 74 disposed in the side surface of the hammer 34 positioned adjacent the lockarm 110 (see FIG. 7). The lock slot 74 is positioned so that the lock slot 74 aligns with the hammer post 124 when the hammer 34 is in the uncocked position. In the safety-off condition, the hammer post 124 is disposed in the arcuate slot 80 of the hammer 34 and the flag 126 resides within the revolver frame adjacent the hammer, out of sight. FIG. 9 shows the lockarm actuator 112 in the safety-off condition. When the hammer 34 is drawn back in this condition, the hammer 34 pivots relative to the lockarm 110, rotating past the hammer post 124 that is disposed within the arcuate slot 80. In this condition, the revolver can be fired without obstruction from the lockarm 110.

To actuate the safety lock mechanism 20 into the safety-on condition, the operator rotates the lockarm actuator 112 clockwise using a driver tool (e.g., a screwdriver, a torx driver, etc.). When the lockarm actuator 112 is rotated clockwise, the cam lobe 134 engages the cam surface 118 of the lockarm 110 causing the lockarm 110 to pivot about the pivot post. The cam lobe 134 rotates the lockarm 110 an amount sufficient to move the hammer post 124 out of the arcuate slot 80 and into the aligned lock slot 74. At the same time, the rotation of the lockarm 110 causes the flag 126 to rise out of the frame into a visible position. In the safety-on and off positions, this embodiment also does not interact with or obstruct the cylinder release bar 26 (see FIG. 2), thereby allowing opening and closing of the cylinder 14.

Figure 10:
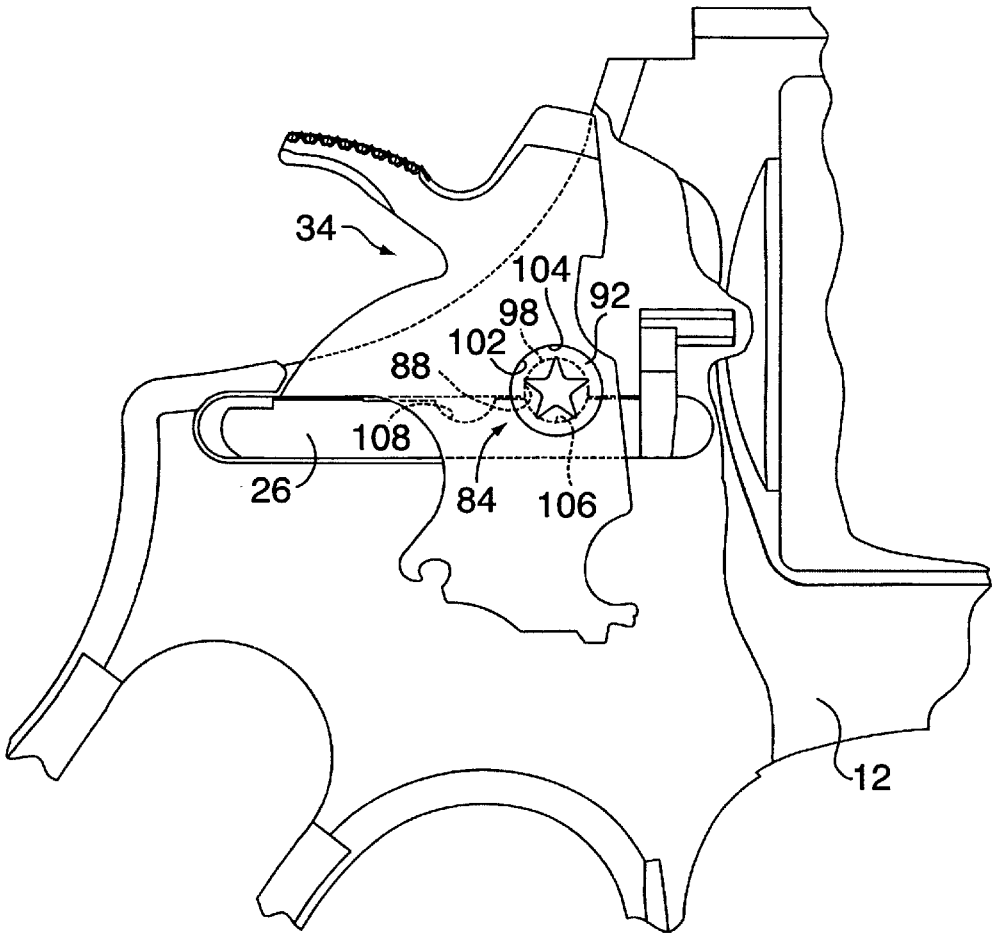
FIG. 10 is a partial sectioned diagrammatic view of a revolver showing an embodiment of the present invention safety lock mechanism that includes a lockpin and a plunger.
Figure 11:
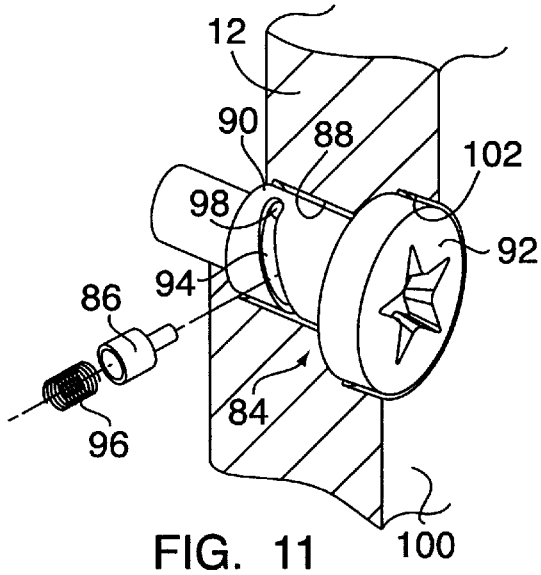
FIG. 11 is a diagrammatic isometric view of the lockpin, plunger, and plunger spring.

Now referring to FIGS. 10 and 11, a third embodiment of the safety lock mechanism 20 includes a lockpin 84 and a plunger 86. The lockpin 84 is mounted in a bore 88 that extends through at least one side surface of the frame 12 and aligns with the hammer 34 and the cylinder release bar 26. The lockpin 84 has a body 90, a head 92, and a groove 94 disposed in the body 90. In a preferred embodiment the groove 94 follows a helical path. The plunger 86 is mounted in or on the frame 12. A spring 96 or other biasing mechanism biases the plunger 86 into the lockpin body groove 94. The lockpin 84 includes a pair of detents 98 disposed within the groove 94. One of the detents 98 is positioned to align with the plunger 86 when the lockpin 84 is in the "safety-on" condition. The other detent 98 is positioned to align with the plunger 86 when the lockpin 84 is in the "safety-off" position. When the plunger 86 is aligned with either detent 98, the spring 96 biases the plunger 86 into the detent 98. As a result, the lockpin 84 is held in place. The head 92 of the lockpin 84 can extend outside of or be flush with the frame side surface 100. The head 92 of the lockpin 84 can have the same outer diameter as the body 90 of the lockpin 84 or can be a greater diameter. The portion of the frame bore 88 that receives the lockpin 84 may have a countersink 102 to accept a larger diameter head 92. In that case, the lockpin head 92 may be received within the countersink portion 102 of the bore 88 in both the safety-on and safety-off positions, and thereby be flush with or below the frame side surface 100. Alternatively, the lockpin 84 and bore 88 can be configured such that the lockpin head 92 resides within the countersink 102 when safety is on and extends outside the frame side surface 100 when the safety is off. In this case, the lockpin head 92 that extends outside of the frame 12 can be brightly colored to flag the operator that the revolver is in a safety-off condition.

Still referring to embodiment FIGS. 8 and 9, note that the present invention provides for a more tamper proof lock than those found in the prior art. As seen in FIGS. 8 and 9, the frame 12 has a frame extension 13 that partially defines a frame cavity in which the hammer rotates. The frame extension and frame are adapted to receive a side plate (not shown), thereby enclosing the interior components of the revolver. The frame extension 13 partially encloses the hammer during part of its rotational travel.

A lock mechanism as provided by the present invention is characterized, in a preferred embodiment by little or low permissible rotational movement of the hammer when the lock mechanism is engaged. As a result, the hammer cannot be rotated clear of the frame extension 13 and therefore cannot be removed from the gun when the locking mechanism is engaged, even though the side plate has been removed and would otherwise give access to the internal components of the revolver. Similarly, since the hammer cannot be removed, the elements of the locking mechanism cannot be accessed and cannot be tampered with or removed. Prior art mechanisms allow for easy access to internal elements and therefore, can be readily modified or replaced.

In the second embodiment of the safety lock mechanism, the hammer 34 includes an aperture, notch, or other shaped feature 104 (hereinafter collectively to as a "characteristic") for receiving the lockpin 84. The characteristic 104 is positioned relative to the lockpin 84 such that when the hammer 34 is in the uncocked position, the lockpin 84 aligns with the characteristic 104. The cylinder release bar 26 includes a cylinder-closed characteristic 106 and a cylinder-opened characteristic 108 (shown in FIG. 8 in the form of a pair of notches). The cylinder-closed characteristic 106 aligns with the lockpin 84 when the cylinder release bar 26 is in its default position. The cylinder-opened characteristic 108 aligns with the lockpin 84 when the cylinder release bar 26 is in the cylinder-release position. If the operator wishes to render the revolver 10 inoperable and fix the cylinder 14 closed, the operator leaves cylinder release bar 26 in its default position and actuates the lockpin 84 via a driver tool into the safety-on condition. In this condition, the lockpin 84 engages the hammer characteristic 104 and the cylinder-closed characteristic 106 of the cylinder release bar 26. If the operator wishes render the revolver 10 inoperable and fix the cylinder release bar 26 so that the cylinder 14 may be opened, the operator actuates the cylinder release bar 26 into the cylinder-release position and actuates the lockpin 84 via a driver tool into the safety-on condition. In this condition, the lockpin 84 engages the hammer characteristic 104 and the cylinder-open characteristic 108 of the cylinder release bar 26.

Although this invention has been shown and described with respect to the detailed embodiments thereof, it will be understood by those skilled in the art that various changes in form and detail thereof may be made without departing from the spirit and scope of the invention.

What is claimed is:

1. A revolver having a frame, barrel, cylinder, and trigger, said revolver comprising:

a hammer having a normal slot and a lock slot;

a lockarm having a cam surface and hammer post, wherein the lockarm is pivotally mounted relative to the frame; and a lockarm actuator disposed in the frame, the lockarm actuator including a cam, and the cam is aligned with the cam surface of the lockarm so as to be engageable with the cam surface;

wherein the lockarm actuator can be positioned in a safety-off condition in which the hammer post of the lockarm is received within the normal slot of the hammer and the hammer is operable, and in a safety-on condition in which the hammer post is received within the lock slot and the hammer is inoperable.

2. The revolver of claim 1, wherein the lock slot is connected with and extends off of the normal slot, and wherein when the hammer is in an uncocked position, the hammer post aligns with the lock slot.

3. The revolver of claim 2, wherein the lockarm further includes a pivot post and the pivot post is received within an aperture disposed in the frame, wherein the lockarm pivots relative to the frame about the pivot post.

4. The revolver of claim 3, wherein the lockarm is biased within the frame.

5. The revolver of claim 4, further comprising a lockarm spring, wherein the lockarm spring biases the lockarm within the frame.

6. The revolver of claim 5, wherein the lock arm further includes a spring mount post and the lockarm spring is mounted on the spring mount post.

7. The revolver of claim 6, wherein the lockarm spring further includes a first leg that acts on the lockarm, and a second leg that acts on the lockarm actuator.

8. The revolver of claim 7, wherein the lockarm actuator includes a relief for receiving the second leg, wherein the second leg received within the relief retains the lockarm actuator within an aperture disposed within a wall of the frame.

9. The revolver of claim 8, wherein said lockarm further includes a flag, and in the safety-off condition the flag is disposed within the frame, and in the safety-on condition the flag is disposed outside of the frame to signal an operator the lockarm is engaged.

10. The revolver of claim 1, wherein said lockarm further includes a flag, and in the safety-off condition the flag is disposed within the frame, and in the safety-on condition the flag is disposed outside of the frame to signal an operator the lockarm is engaged.

11. The revolver of claim 1, wherein the cam and cam surface cooperate with each other in such a way that the lockarm is prevented from being moved into the frame when the lockarm actuator is in the lockarm engaged position.

12. The revolver of claim 1, further comprising:

a lock arm actuator catch; and a lockarm actuator spring;

wherein the lockarm actuator spring biases the lock arm actuator catch into engagement with the lockarm actuator thereby maintaining the lockarm actuator in one of the safety-on position or the safety-off position.

13. The revolver of claim 12, wherein said lockarm actuator includes a catch tab extending out from a head, and the lockarm actuator includes a safety-on notch and a safety-off notch, and wherein the catch tab is engaged with one of the safety-on notch or safety-off notch and can be selectively moved to engage the other of the safety-on notch or safety-off notch.

14. The revolver of claim 1, wherein said frame further comprises a frame extension that defines a frame cavity, and wherein said hammer post is received within the lock slot so as to remove substantially all rotational movement of the hammer relative to the frame; said hammer being received in said frame cavity in the safety on condition, said frame extension having a magnitude to preclude removal of said hammer from said frame while in the safety on condition.

15. A revolver having a frame, barrel, and trigger, said revolver comprising:

a hammer;

a cylinder; and a lockpin extendable into the frame;

wherein the lockpin can be positioned in a disengaged position in which the lockpin is disengaged from the hammer and a cylinder release bar, and in an engaged position in which the lockpin is engaged with the hammer in such a manner that the hammer is maintained in an uncocked position, and is engaged with the cylinder release bar in such a manner that the cylinder release bar is maintained in a cylinder-release position, thereby permitting rotation of the cylinder out of the frame.

16. The revolver of claim 15, wherein the lockpin includes a groove, and wherein a plunger mounted relative to the frame extends into the groove.

17. The revolver of claim 16, herein the groove extends along a helical path.

18. The revolver of claim 17, wherein the plunger is biased into the groove.

19. The revolver of claim 18, wherein the lockpin includes a pair of detents disposed within the groove.

20. The revolver of claim 19, wherein the cylinder release bar includes a cylinder-closed characteristic and a cylinder-open characteristic that are engageable by the lockpin.

21. The revolver of claim 15, wherein said lockpin is mounted in a bore disposed in the frame, and wherein in the disengaged position a head of the lockpin extends outside of the bore, and in the engaged position the head of the lockpin is disposed within the bore.

22. A revolver having a frame, barrel, cylinder, and trigger, said revolver comprising:

a hammer having a normal slot and a lock slot;

a lockarm having a cam surface and hammer post, wherein the lockarm is pivotally mounted relative to the frame; and a lockarm actuator disposed in the frame, the lockarm actuator including a cam, and the cam is aligned with the cam surface of the lockarm so as to be engageable with the cam surface;

wherein the lockarm actuator can be positioned in a safety-off condition in which the hammer post of the lockarm is received within the normal slot of the hammer and the hammer is operable, and in a safety-on condition in which the hammer post is received within the lock slot and the hammer is inoperable; and wherein the cylinder can be rotated into a cylinder open position in both the safety-off condition and the safety-on condition.

* * * * *